US008241729B2

(12) United States Patent
Conley et al.

(10) Patent No.: US 8,241,729 B2
(45) Date of Patent: Aug. 14, 2012

(54) BREATHABLE GARMENT HAVING A FLUID DRAINAGE LAYER

(75) Inventors: Jill A Conley, Midlothian, VA (US); Robert Anthony Marin, Midlothian, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 794 days.

(21) Appl. No.: 12/075,388

(22) Filed: Mar. 11, 2008

(65) Prior Publication Data

US 2009/0123700 A1 May 14, 2009

Related U.S. Application Data

(60) Provisional application No. 61/002,820, filed on Nov. 13, 2007.

(51) Int. Cl.
*B32B 5/02* (2006.01)
*B32B 3/26* (2006.01)

(52) U.S. Cl. ..... 428/152; 428/141; 428/300.4; 442/50; 442/268; 442/327; 442/400; 442/401; 442/402; 977/961

(58) Field of Classification Search ..... 428/152, 428/141, 300.4; 442/50, 268, 327, 400, 401, 442/402; 977/961
See application file for complete search history.

(56) References Cited

U.S. PATENT DOCUMENTS

| | | | | |
|---|---|---|---|---|
| 4,127,706 | A | 11/1978 | Martin et al. | |
| 4,420,521 | A | 12/1983 | Carr | |
| 5,204,156 | A | 4/1993 | Lumb et al. | |
| 7,553,371 | B2 * | 6/2009 | Dubrow et al. | 117/90 |
| 2005/0048860 | A1 | 3/2005 | Ying et al. | |
| 2006/0195964 | A1 * | 9/2006 | Bury | 2/108 |
| 2008/0070463 | A1 | 3/2008 | Arora et al. | |
| 2009/0065298 | A1 * | 3/2009 | Ueno | 181/287 |

FOREIGN PATENT DOCUMENTS

| | | |
|---|---|---|
| WO | WO 03/080905 | 10/2003 |
| WO | WO 2009/064311 | 5/2009 |

OTHER PUBLICATIONS

U.S. Appl. No. 11/523,827, filed Sep. 20, 2006, DuPont.
PCT International Search Report and Written Opinion for International Application No. PCT/US2008/003213 dated Nov. 13, 2007.

* cited by examiner

*Primary Examiner* — Brent Ohern

(57) ABSTRACT

A garment includes a breathable composite fabric between outer and inner fabric layers. The breathable composite fabric comprises two nanofiber web layers and a porous fluid drainage layer disposed therebetween.

22 Claims, No Drawings

BREATHABLE GARMENT HAVING A FLUID DRAINAGE LAYER

FIELD OF THE INVENTION

The present invention relates to garments that contain a breathable composite fabric of two nanofiber web layers and a fluid drainage layer there between, and optional inner and outer fabric layers enveloping the composite fabric.

BACKGROUND

It has long been desired to make garments less susceptible to the strikethrough of fluids, e.g., rainwater, blood and oil, through the garments, particularly at points or regions of high pressure, such as at elbows and the seat area of pants.

It is well known to incorporate breathable and waterproof membranes into a garment in order to impart breathability to the garment while making it waterproof and therefore more comfortable to the user. For example expanded polytetrafluoroethylene membranes (ePTFE) have been used for this application.

Over time, soil impingement in the form of body oils and exudates can severely affect membrane performance by blocking the pores in the membrane. Attempts to protect the membrane by coating it with polymers that allow passage of moisture vapor cause a reduction of the breathability of the garment. There is therefore a tradeoff between lifetime and comfort.

It would be desirable to provide garments with improved strikethrough resistance, particularly at high-pressure areas, without adversely affecting the breathability of the garments.

SUMMARY OF THE INVENTION

The present invention relates to a garment comprising a breathable composite fabric, an outer fabric layer and an inner fabric layer, said breathable composite fabric comprising two nanofiber web layers and a porous fluid drainage layer disposed there between.

DETAILED DESCRIPTION OF THE INVENTION

The terms "nanofiber layer," "nanofiber web layer," "nanofiber web" and "nanoweb layer" are used interchangeably herein to refer to a nonowoven that comprises nanofibers.

The term "nanofibers" as used herein refers to fibers having a number average diameter less than about 1000 nm, even less than about 800 nm, even between about 50 nm and 500 nm, and even between about 100 and 400 nm. In the case of non-round cross-sectional nanofibers, the term "diameter" as used herein refers to the greatest cross-sectional dimension.

The term "nonwoven" means a web including a multitude of randomly distributed fibers. The fibers generally can be bonded to each other or can be unbonded. The fibers can be staple fibers or continuous fibers. The fibers can comprise a single material or a multitude of materials, either as a combination of different fibers or as a combination of similar fibers each comprised of different materials.

By "garment" is meant any item that is worn by the user to cover or protect some region of the user's body from weather or other factors in the environment outside the body. For example coats, jackets, pants, hats, gloves, shoes, socks, and shirts are all considered garments under this definition.

The term "outer" when used to describe the location of a layer refers to the face of the garment that faces away form the wearer. The term "inner" refers to the user facing side of the garment.

The term "calendering" refers to the process of passing a web through a nip between two rolls. The rolls may be in contact with each other, or there may be a fixed or variable gap between the roll surfaces. An "unpatterned" roll is one which has a smooth surface within the capability of the process used to manufacture them. There are no points or patterns to deliberately produce a pattern on the web as it passed through the nip, unlike a point bonding roll.

The terms "scrim," "substrate" and "support layer" are used interchangeably to refer to any planar structure with which a nanoweb can be bonded, adhered, or laminated. Advantageously, the scrim layers useful in the present invention are spunbond nonwoven layers, but can be made from carded webs of nonwoven fibers and the like.

Nanofiber web layers for use in the composite fabric of the garment of the invention can be produced by electrospinning, such as classical electrospinning or electroblowing, and in certain circumstances by meltblowing processes. Classical electrospinning is a technique illustrated in U.S. Pat. No. 4,127,706, incorporated herein in its entirety, wherein a high voltage is applied to a polymer in solution to create nanofibers and nonwoven mats. However, total throughput in electrospinning processes is too low to be commercially viable in forming heavier basis weight nanowebs.

The electroblowing process is disclosed in PCT Patent Publication No. WO 03/080905, incorporated herein by reference in its entirety. A stream of polymeric solution comprising a polymer and a solvent is fed from a storage tank to a series of spinning nozzles within a spinneret, to which a high voltage is applied and through which the polymeric solution is discharged. Meanwhile, compressed air that is optionally heated is issued from air nozzles disposed in the sides of, or at the periphery of the spinning nozzle. The air is directed generally downward as a blowing gas stream which envelopes and forwards the newly issued polymeric solution and aids in the formation of the fibrous web, which is collected on a grounded porous collection belt above a vacuum chamber. The electroblowing process permits formation of commercial sizes and quantities of nanowebs at basis weights in excess of about 1 gsm, even as high as about 40 gsm or greater, in a relatively short time period.

Polymer materials that can be used in forming the nanowebs of the invention are not particularly limited and include both addition polymer and condensation polymer materials such as, polyacetals, polyamides, polyesters, polyolefins, cellulose ethers and cellulose esters, polyalkylene sulfides, polyarylene oxides, polysulfones, modified polysulfone polymers, and mixtures thereof. Preferred materials that fall within these generic classes include, poly (vinylchloride), polymethylmethacrylate (and other acrylic resins), polystyrene, and copolymers thereof (including ABA type block copolymers), poly (vinylidene fluoride), poly (vinylidene chloride), polyvinylalcohol in various degrees of hydrolysis (87% to 99.5%) in crosslinked and non-crosslinked forms. Preferred addition polymers tend to be glassy (a $T_g$ greater than room temperature). This is the case for polyvinylchloride and polymethylmethacrylate, polystyrene polymer compositions or alloys or low in crystallinity for polyvinylidene fluoride and polyvinylalcohol materials. One preferred class of polyamide condensation polymers are nylon materials, such as nylon-6, nylon-6, 6, nylon 6, 6-6, 10, and the like. When the polymer nanowebs of the invention are formed by meltblowing, any thermoplastic polymer capable of being meltblown into nanofibers can be used, including polyolefins, such as polyethylene, polypropylene and polybutylene, polyesters such as poly (ethylene terephthalate) and polyamides, such as the nylon polymers listed above. The nanowebs can be formed from the same polymer, or the nanowebs can each be formed from different polymers.

It can be advantageous to add known-in-the-art plasticizers to the various polymers described above, in order to reduce the $T_g$ of the fiber polymer. $T_g$ is herein defined as the temperature at which the polymer undergoes a transition from glassy to rubbery state. Suitable plasticizers will depend upon the polymer to be electrospun or electroblown, as well as upon the particular end use into which the nanoweb will be introduced. For example, nylon polymers can be plasticized with water or even residual solvent remaining from the electrospinning or electroblowing process. Other known-in-the-art plasticizers which can be useful in lowering polymer $T_g$ include, but are not limited to aliphatic glycols, aromatic sulphanomides, phthalate esters, including but not limited to those selected from the group consisting of dibutyl phthalate, dihexl phthalate, dicyclohexyl phthalate, dioctyl phthalate, diisodecyl phthalate, diundecyl phthalate, didodecanyl phthalate, and diphenyl phthalate, and the like. The *Handbook of Plasticizers*, edited by George Wypych, 2004 Chemtec Publishing, incorporated herein by reference, discloses other polymer/plasticizer combinations which can be used in the present invention.

The as-spun nanoweb of the present invention can be calendered in order to impart the desired physical properties to the fabric of the invention, as disclosed in co-pending U.S. patent application Ser. No. 11/523,827, filed Sep. 20, 2006 and incorporated herein by reference in its entirety. The as-spun nanoweb can be fed into the nip between two unpatterned rolls in which one roll is an unpatterned soft roll and one roll is an unpatterned hard roll, and the temperature of the hard roll is maintained at a temperature that is between the $T_g$ and the $T_{om}$, herein defined as the temperature of the onset of melting of the polymer, such that the nanofibers of the nanoweb are at a plasticized state when passing through the calender nip. The composition and hardness of the rolls can be varied to yield the desired end use properties of the fabric. One roll can be a hard metal, such as stainless steel, and the other a soft-metal or polymer-coated roll or a composite roll having a hardness less than Rockwell B 70. The residence time of the web in the nip between the two rolls is controlled by the line speed of the web, preferably between about 1 m/min and about 50 m/min, and the footprint between the two rolls is the MD distance that the web travels in contact with both rolls simultaneously. The footprint is controlled by the pressure exerted at the nip between the two rolls and is measured generally in force per linear CD dimension of roll, and is preferably between about 1 mm and about 30 mm.

Further, the nanofiber web can be stretched, optionally while being heated to a temperature that is between the $T_g$ and the lowest $T_{om}$ of the nanofiber polymer. The stretching can take place either before and/or after the web is fed to the calender rolls and in either or both the machine direction or cross direction.

The nanofiber web can further comprise antistatic agents, antimicrobial agents, processing additives, colorants and the like.

The breathable composite fabric according to the present invention includes a fluid drainage layer disposed between the two nanofiber layers. The fluid drainage layer prevents fluid strikethrough of fluid subjected to force or pressure, such as driven rain water, fluids been driven in by compression at elbows, seat area, etc. by reducing the pressure of the fluid which penetrates the outer nanoweb, such that the inner nanoweb is subjected to a significantly reduced fluid pressure. The fluid drainage layer is a flexible structure having a thickness and mean pore size sufficient to allow fluid that has penetrated through either the inner or outer nanofiber web layer and come into contact with the fluid drainage layer to quickly pass through the fluid drainage layer and away from the compressed region. The mean pore size of the fluid drainage layer can be greater than the mean pore size of the inner and outer nanofiber web layers on either side of the fluid drainage layer. The thickness of the fluid drainage layer can be as thick, and advantageously thicker, than the thicker of the nanofiber web layers. When the fluid drainage layer is hydrophobic, greater pore sizes and porosity are preferred in order to facilitate the drainage of fluid. The material of the fluid drainage layer can be non-absorbent and porous so that in the event that fluid penetrates to the fluid drainage layer, the fluid is less likely to fully wet the fluid drainage layer and/or penetrate to the other nanofiber web layer. By "porous" is meant that the layer has an air permeability of at least 0.05 cubic meters per minute per square meter ($m^3/min/m^2$) at 20 mm water gauge. Layers with air permeabilities of 200 $m^3/min/m^2$ at 20 mm water or more can be used.

Alternatively, the material of the fluid drainage layer can be absorbent and have a high wicking rate, so that in the event that fluid penetrates to the fluid drainage layer, the fluid will be quickly transported away from the penetration site.

The fluid drainage layer can be selected from the group consisting of spunbonded nonwovens, carded nonwovens, needlepunched nonwovens, air-laid nonwovens, wet-laid nonwovens, spunlaced nonwovens, spunbonded-meltblown-spunbonded nonwovens, woven fabrics, knit fabrics, meltblown nonwovens, three-dimensional meshes, nanofiber layers, combinations thereof and the like. The fluid drainage layer is optionally textured or creped to create channels in the drainage layer which direct and facilitate the passage of fluid through the fluid drainage layer and away from the compressed region. If the fluid drainage layer includes a nanofiber layer, it can be advantageous to provide a hydrophilic treatment of the nanofiber layer in order to increase the wicking rate of the fluid drainage layer.

The fluid drainage layer can be used as a collection substrate in the process for forming the nanofiber webs, by arranging the fluid drainage layer on the nanofiber web collector to collect and combine the nanofiber web spun on the substrate. The resulting combined web/fluid drainage layer can be used in the composite fabric of the garment of the invention.

The composite fabric formed by the two nanofiber web layers and the fluid drainage layer there between is breathable and can have an air permeability of between about 0.5 CFM/$ft^2$ (0.15 $m^3/min/m^2$) and about 25 CFM/$ft^2$ (7.6 $m^3/min/m^2$) and a moisture vapor transmission rate of at least about 500 $g/m^2/24$ hr.

The fluid drainage layer and nanowebs can be optionally bonded to each other. All three layers can be bonded to each other simultaneously by point bonding or ultrasonic bonding, or only two of the three layers can be bonded. For example, the fluid drainage layer can be bonded to an adjacent nanofiber web layer. Alternatively, the nanofiber web layers can be bonded to each other in such a way that the pattern of bonded regions defines a void or space between the nanowebs where the nanowebs are not bonded. The fluid drainage layer can be disposed in the void, unattached to the nanowebs. Examples of suitable bonding techniques include adhesive bonding, thermal bonding such as point bonding, and ultrasonic bonding, although any means for bonding known to one skilled in the art can be employed.

In order to improve the liquid strikethrough resistance of the composite fabric and of the garment including the composite fabric, at least one of the nanofiber web layers, preferably the outermost nanofiber web layer, can be treated with known-in-the-art fluorine-containing compounds to improve the fluid repellency of the layer(s), and render the nanofiber web layer hydrophobic and oleophobic.

In the case of adhesive bonding, the adhesive used can be any of a variety of adhesives, including dispersions and synthetic latexes. Preferably, the adhesive should have similar or better chemical resistance and thermal resistance properties than those of the fibers used in the composite fabric. Possible adhesive systems include aqueous anionic dispersions of butadiene acrylonitrile copolymers, copolymers based on acrylic esters, vinyl and vinylidene chloride polymers and copolymers produced by emulsion polymerization, styrene-butadiene copolymers, and terpolymers of butadiene, styrene, and vinyl pyridine.

Different methods of adhesively bonding the nanoweb(s) to the fluid drainage layer can be used. For example, the nanoweb(s) can be first coated in the required areas with adhesive and then the fluid drainage layer is placed in contact with the adhesive on the coated nanoweb(s). Ample heat and pressure are applied to cause the adhesive to flow into some of the pores of the nanoweb and fluid drainage layer. If the adhesive is cross-linkable, the adhesive cross-links due to the heat and results in a mechanical attachment of the nanoweb and fluid drainage layer. In a preferred embodiment, the nanoweb and fluid drainage layer are bonded using a suitable lamination technique, such as passing the materials through a nip at a temperature sufficient to melt the adhesive. One of the nip rolls can have a raised pattern on its surface in order to produce a point bonding pattern in the laminate.

The composite fabric is located in the garment between an outer fabric layer and an inner fabric layer. A wide variety of natural and synthetic fabrics are known and may be used as the outer and inner fabric layers. Typically, vestments designed for use as rugged outerwear have been constructed of relatively loosely-woven fabrics made from natural and/or synthetic fibers having a relatively low strength or tenacity (for example, nylon, cotton, polyesters, polyacrylics, polypropylene, etc.), with each fiber having a tensile strength or tenacity of less than about 8 grams per denier (gpd), more typically less than about 5 gpd, and in some cases below about 3 gpd. Such materials can have a variety of beneficial properties, for example, dyeability, breathability, lightness, comfort, and in some instances, abrasion-resistance.

Different weaving structures and different weaving densities may be used to provide several alternative woven fabrics as a component of the invention. Weaving structures such as plain woven structures, reinforced plain woven structures (with double or multiple warps and/or wefts), twill woven structures, reinforced twill woven structures (with double or multiple warps and/or wefts), satin woven structures, reinforced satin woven structures (with double or multiple warps and/or wefts) may be used. Stretch woven fabrics, ripstops, dobby weaves, and jacquard weaves are also suitable for use in the present invention.

Nonwoven fabrics can alternatively be used as the outer fabric layer and optional inner fabric layer. Examples of nonwoven sheets include spunbonded webs, melt blown webs, multi-directional, multi-layer carded webs, air-laid webs, wet-laid webs, spunlaced webs and composite webs comprising more than one nonwoven sheet. Suitable spunbonded webs comprise polyolefin fibers, particularly polyethylene or polypropylene. The polyolefin fibers may contain minor amounts of other comonomer units. As used herein, the term "spunbonded web" means nonwoven web formed of filaments which have been extruded, drawn, and deposited on a continuous collection surface. Bonding can be accomplished by any of several methods including point or pattern bonding, calendering or passing the nonwoven fabric through a saturated-steam chamber at an elevated pressure. An example of a suitable spunbonded polyolefin sheet material is flash spun polyethylene available under the trade name Tyvek® from E. I. du Pont de Nemours and Company.

The composite fabric may be bonded to the inner fabric layer and/or outer fabric layer over some fraction of its surface by any known means, for example adhesively, thermally, using an ultrasonic field, or by solvent bonding. One or more adhesives may optionally be used to bond the composite fabric to the inner and/or outer layer fabrics. One suitable adhesive is a thermoplastic adhesive, which can be softened upon heating, then hardened upon cooling over a number of heating and cooling cycles. An example of such a thermoplastic adhesive is a hot melt adhesive. In one embodiment the nanoweb is bonded adhesively using a solution of a polymeric adhesive such as a polyurethane, and allowing the solvent to evaporate. In a further embodiment, when the nanoweb is electrospun directly onto a fabric, the solvent in which the nanoweb is spun is used to achieve solvent bonding.

The invention claimed is:

1. A garment comprising a breathable composite fabric, an outer fabric layer and an inner fabric layer, said breathable composite fabric comprising two nanofiber web layers and a porous fluid drainage layer disposed therebetween.

2. The garment of claim 1 wherein the fluid drainage layer is bonded to one or both nanofiber web layers by means of adhesive bonding, thermal bonding, ultrasonic bonding, solvent bonding or any combination thereof.

3. The garment of claim 1 wherein the composite fabric is bonded to at least one of the outer and inner fabric layers.

4. The garment of claim 1 wherein the fluid drainage layer is selected from the group consisting of spunbonded nonwovens, carded nonwovens, needlepunched nonwovens, air-laid nonwovens, wet-laid nonwovens, spunlaced nonwovens, spunbonded-meltblown-spunbonded nonwovens, woven fabrics, knit fabrics, meltblown nonwovens, three-dimensional meshes, nanofiber layers and combinations thereof.

5. The garment of claim 4 wherein the fluid drainage layer is textured or creped to facilitate the passage of fluid therethrough.

6. The garment of claim 1 wherein the breathable composite fabric has an air permeability of between about 0.15 $m^3/min/m^2$ and about 7.6 $m^3/min/m^2$ and a moisture vapor transmission rate of at least about 500 $g/m^2/day$.

7. The garment of claim 1 wherein the outermost nanofiber web layer is treated with a fluorine-containing compound.

8. The garment of claim 1 wherein the mean pore size of the fluid drainage layer is at least as large as the mean pore size of one of the nanofiber web layers and the fluid drainage layer is at least as thick as the thicker of the nanofiber web layers.

9. The garment of claim 1 wherein the fluid drainage layer is non-absorbent.

10. The garment of claim 1 wherein the fluid drainage layer is absorbent.

11. The garment of claim 1 wherein the outer and inner fabric layers are woven fabrics comprising fibers selected from the group consisting of nylon, cotton, polyesters, polyacrylics, polypropylene, and combinations thereof.

12. The garment of claim 1 wherein the nanofiber web layers are bonded to each other in a pattern defining a void therebetween and the fluid drainage layer is unattachedly disposed between the nanofiber web layers within the void.

13. The garment of claim 1 wherein the nanofiber web layers are produced by electrospinning or electroblowing directly onto the surface of the fluid drainage layer and the nanofiber web layers and the fluid drainage layer are bonded to each other by residual solvent from the electrospinning or electroblowing processes.

14. The garment of claim 1 wherein the nanofiber web layers comprise nanofibers of a polymer selected from the group consisting of polyacetals, polyamides, polyesters, cellulose ethers, cellulose esters, polyalkylene sulfides, polyarylene oxides, polysulfones, modified polysulfone polymers and mixtures thereof.

15. The garment of claim 1 wherein the nanofiber web layers comprise nanofibers of a polymer selected from the group consisting of poly(vinylchloride), polymethylmethacrylate, polystyrene, and copolymers thereof, poly(vinylidene fluoride), poly(vinylidene chloride), polyvinylalcohol in crosslinked and non-crosslinked forms.

16. The garment of claim 1 wherein the nanofiber web layers comprise nanofibers of a polymer selected from the group consisting of nylon 6, nylon 6, 6, and nylon 6, 6-6, 10.

17. The garment of claim 1 wherein each of the two nanofiber web layers comprises a different polymer.

18. The garment of claim 1 wherein the nanofiber web layers are calendered.

19. The garment of claim 1 wherein the composite fabric is calendered.

20. The garment of claim 1 wherein the composite fabric is calendered while in contact with the inner and outer fabric layers.

21. The garment of claim 1 wherein at least one of the nanofiber web layers is either oleophobic or hydrophobic.

22. The garment of claim 1 wherein the outer and inner fabric layers are nonwoven fabrics.

* * * * *